US009325103B2

(12) United States Patent
Arai et al.

(10) Patent No.: US 9,325,103 B2
(45) Date of Patent: Apr. 26, 2016

(54) CONNECTOR HAVING A HOUSING AND A SEALING MEMBER WITH CONTACT PORTION AND ACCOMODATED PORTION HELD IN AN ACCOMODATION PORTION OF THE HOUSING

(71) Applicant: Japan Aviation Electronics Industry, Limited, Tokyo (JP)

(72) Inventors: Katsumi Arai, Tokyo (JP); Toshiro Kobuchi, Tokyo (JP); Takayuki Nishimura, Tokyo (JP); Hiroaki Obikane, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/428,734

(22) PCT Filed: Nov. 8, 2013

(86) PCT No.: PCT/JP2013/080182

§ 371 (c)(1),
(2) Date: Mar. 17, 2015

(87) PCT Pub. No.: WO2014/087791

PCT Pub. Date: Jun. 12, 2014

(65) Prior Publication Data

US 2015/0222044 A1 Aug. 6, 2015

(30) Foreign Application Priority Data

Dec. 3, 2012 (JP) ..... 2012-264173

(51) Int. Cl.

| | |
|---|---|
| ***H01R 12/00*** | (2006.01) |
| ***H01R 13/52*** | (2006.01) |
| ***H01R 12/71*** | (2011.01) |

(52) U.S. Cl.
CPC ..... *H01R 13/5219* (2013.01); *H01R 12/716* (2013.01)

(58) Field of Classification Search
CPC ..... H01R 13/5219
USPC ..... 439/65, 74, 276, 281, 732
See application file for complete search history.

(56) References Cited

U.S. PATENT DOCUMENTS 3,115,380 A * 12/1963 Kuehl ..... H01R 13/523 174/12 R
4,417,736 A * 11/1983 Herrmann, Jr. ..... H01R 13/53 277/606

(Continued)

FOREIGN PATENT DOCUMENTS

| | | | |
|---|---|---|---|
| JP | 2000-299160 | A | 10/2000 |
| JP | 2006-66216 | A | 3/2006 |
| JP | 2011-146286 | A | 7/2011 |

OTHER PUBLICATIONS

International Search Report of PCT/JP2013/080182, mailed Feb. 10, 2014.

*Primary Examiner* — Tho D Ta
(74) *Attorney, Agent, or Firm* — Collard & Roe, P.C.

(57) ABSTRACT

This connector is capable of engaging with a mating-side connector along the vertical direction. The connector is provided with a housing, a plurality of contacts, and a seal member. The housing has a top surface in the vertical direction, and an accommodation part recessed downward from the top surface. The contacts are held in the housing. The contacts are partially accommodated in the accommodation part. The seal member has a contact part and an accommodated part. The contact part is located on the top surface of the housing. The accommodated part extends from the contact part into the accommodation part. The accommodated part is held inside the accommodation part.

9 Claims, 10 Drawing Sheets

(56) References Cited

U.S. PATENT DOCUMENTS 5,580,266 A * 12/1996 Shelly ..... H01R 13/53
439/281

7,530,830 B1 * 5/2009 Lenox ..... H01R 13/5219
439/248

7,914,308 B2 * 3/2011 Boyd ..... H01R 13/113
439/180

* cited by examiner

CONNECTOR HAVING A HOUSING AND A SEALING MEMBER WITH CONTACT PORTION AND ACCOMODATED PORTION HELD IN AN ACCOMODATION PORTION OF THE HOUSING

CROSS REFERENCE TO RELATED APPLICATIONS

This application is the National Stage of PCT/JP2013/080182 filed on Nov. 8, 2013, which claims priority under 35 U.S.C . §119 of Japanese Application No. 2012-264173 filed on Dec. 3, 2012, the disclosure of which is incorporated by reference. The international application under PCT article 21(2) was not published in English.

TECHNICAL FIELD

This invention relates to a connector which waterproofs and protects a contact section between a contact-point of a contact and a contact-point of a mating contact.

BACKGROUND ART

For example, this type of connector is disclosed in each of Patent Document 1 and Patent Document 2.

As shown in FIG. 19, a socket connector (connector) 1100 disclosed in Patent Document 1 comprises a socket connector housing (housing) 1110, a plurality of contacts 1120 and a sealing member 1130. The contacts 1120 are held within the housing 1110. The sealing member 1130 is held by the housing 1110 so as to cover an upper surface and a circumference surface of the housing 1110. When a mating connector (not shown) is mated with the connector 1100 along an upper-lower direction (mating direction) from above the connector 1100, a mating portion between the connector 1100 and the mating connector is sealed by the sealing member 1130. Accordingly, a contact section between a contact-point of the contact 1120 and a contact-point of the mating contact (not shown) can be waterproofed and protected.

As can be seen from FIG. 20, a female connector (connector) 1200 disclosed in Patent Document 2 is mateable with a male connector (mating connector) 1300. The connector 1200 comprises a housing 1210, a plurality of female terminals (contacts) 1220 and an insulative resin (sealing member) 1230. The contacts 1220 are held within the housing 1210. The sealing member 1230 is filled within the housing 1210. The mating connector 1300 comprises a housing (mating housing) 1310, a plurality of male terminals (mating contacts) 1320 and an insulative resin (sealing member) 1330. The mating contacts 1320 are held within the mating housing 1310. The sealing member 1330 is filled within the mating housing 1310. When the connector 1200 and the mating connector 1300 are mated with each other, a mating portion between the connector 1200 and the mating connector 1300 is sealed by the sealing member 1230 and the sealing member 1330. Accordingly, a contact section between a contact-point of the contact 1220 and a contact-point of the mating contact 1320 can be waterproofed and protected.

PRIOR ART DOCUMENTS

Patent Documents

Patent Document 1: JP A 2011-146286
Patent Document 2: JP A 2000-299160

SUMMARY OF INVENTION

Technical Problem

The sealing member 1130 of Patent Document 1 is fitted to an annular recess formed on the circumference surface of the housing 1110 and thus held by the housing. When the housing 1110 holds the sealing member 1130, the sealing member 1130 protrudes from the circumference surface of the housing 1110. Accordingly, the connector 1100 increases in its size, in particular in size in a plane perpendicular to the mating direction.

According to Patent Document 2, in order for the contacts 1220 and the mating contacts 1320 to be waterproofed and protected, the connector 1200 and the mating connector 1300 need to be provided with the sealing member 1230 and the sealing member 1330, respectively. Accordingly, the number of components and the number of manufacturing steps increase. In other words, manufacturing cost increases.

It is therefore an object of the present invention to provide a connector which comprises a sealing member without increasing in its size in a mating face thereof, and which can waterproof and protect a contact section between a contact-point of a contact and a contact-point of a mating contact even if the mating connector is provided with no sealing member.

Solution to Problem

An aspect of the present invention provides a connector mateable with a mating connector along an upper-lower direction. The connector comprises a housing, a plurality of contacts and a sealing member. The housing has an upper face in the upper-lower direction and an accommodation portion recessed downward from the upper face. The contacts are held by the housing and partially accommodated in the accommodation portion. The sealing member has a contact portion and an accommodated portion. The contact portion is located on the upper face of the housing. The accommodated portion is held in the accommodation portion and extends into the accommodation portion from the contact portion.

Advantageous Effects of Invention

According to the present invention, the sealing member can be consist of the contact portion and the accommodated portion, wherein the contact portion is located on the upper face of the housing, and the accommodated portion extends from the contact portion toward the inside of the accommodation portion of the housing. Accordingly, the connector can comprise the sealing member without increasing in its size in a plane perpendicular to a mating direction.

Moreover, according to the present invention, the contact portion of the sealing member is located on the upper face of the housing. Accordingly, even if the mating connector comprises no sealing member, a contact section between a contact-point of the contact and a contact-point of the mating contact can be waterproofed and protected by bringing the contact portion into close contact with a part of the mating connector or a support member which supports the mating connector.

An appreciation of the objectives of the present invention and a more complete understanding of its structure may be had by studying the following description of the preferred embodiment and by referring to the accompanying drawings.

DESCRIPTION OF EMBODIMENTS

Figure 1:
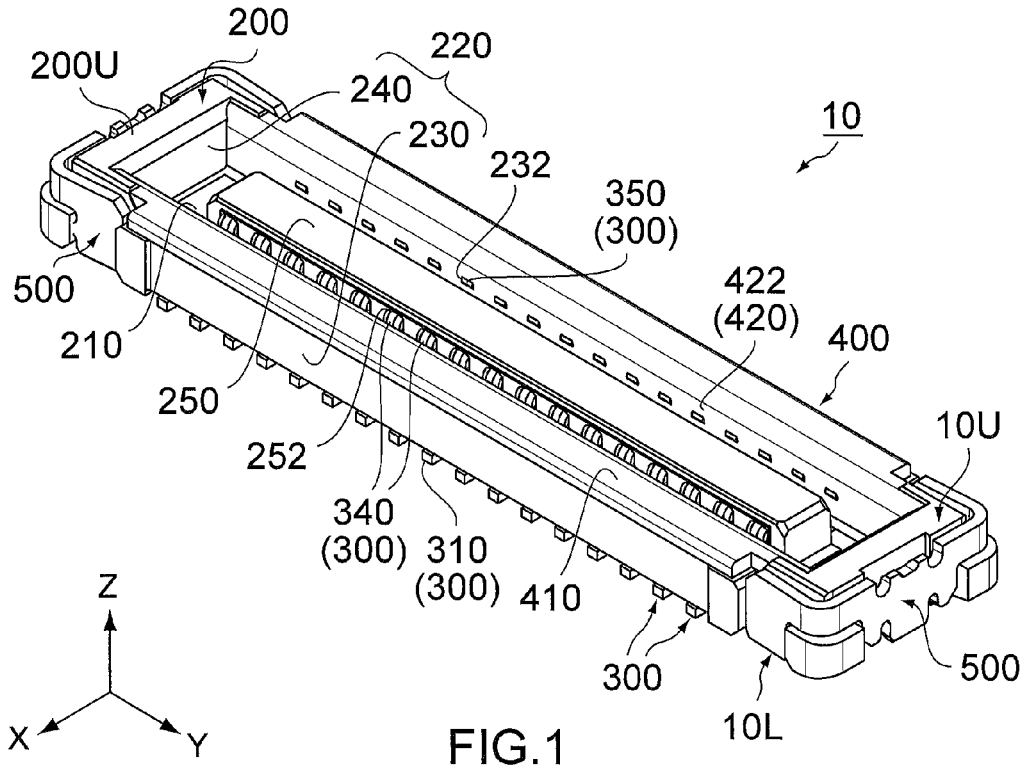
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

As can be seen from FIGS. 1 and 16 to 18, a connector 10 according to an embodiment of the present invention is a receptacle while a mating connector 90 is a plug. The connector 10 is mountable on an upper surface 80U of a circuit board 80 in an upper-lower direction (Z-direction), and the mating connector 90 is mountable on a lower surface 980L of a mating circuit board 980 in the Z-direction (see FIG. 18). The connector 10 mounted on the circuit board 80 is mateable with the mating connector 90 mounted on the mating circuit board 980 along the Z-direction. In other words, the Z-direction is a mating direction of the connector 10 and the mating connector 90 in the present embodiment.

Figure 16:
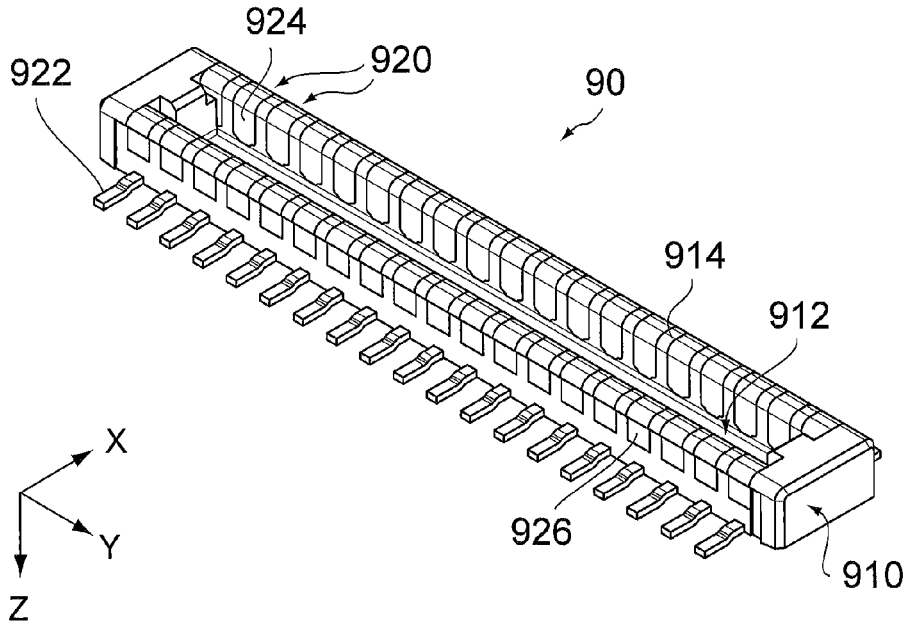
FIG. 16 is a perspective view showing a mating connector mateable with the connector of FIG. 1.
Figure 17:
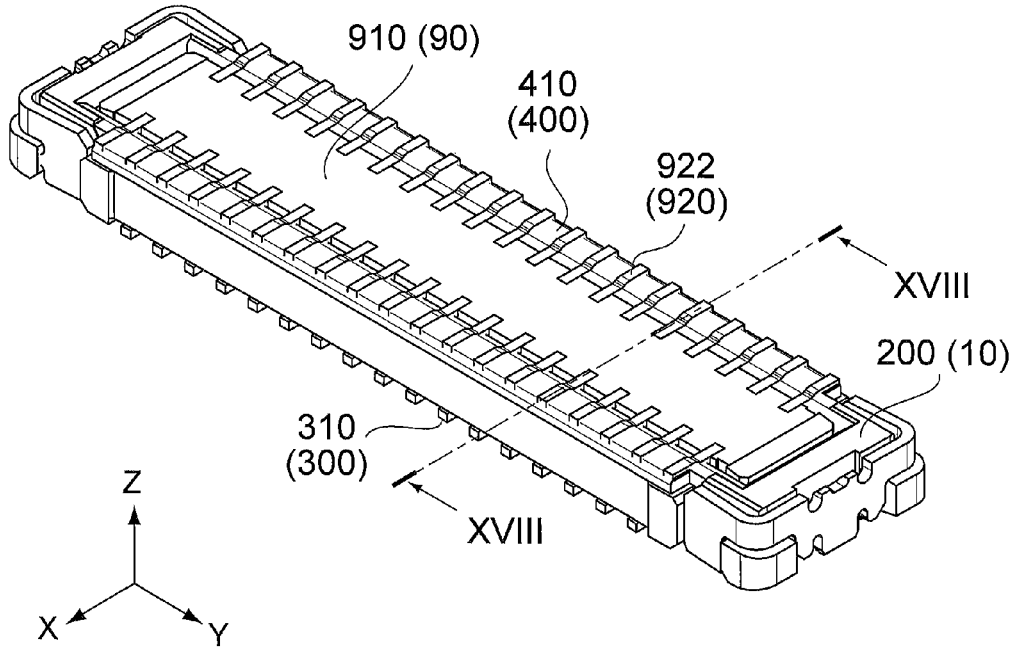
FIG. 17 is a perspective view showing the connector of FIG. 1 and the mating connector of FIG. 16, wherein the connector and the mating connector are in a mated state where they are mated with each other.

As shown in FIG. 16, the mating connector 90 comprises a mating housing 910 made of insulator and a plurality of mating contacts 920 each made of conductor. The mating housing 910 has a rectangular box-like shape. In detail, the mating housing 910 has a recess 912 and a protruding portion 914. The recess 912 is recessed in the positive Z-direction. The protruding portion 914 encloses the recess 912 in a plane perpendicular to the Z-direction.

Figure 18:
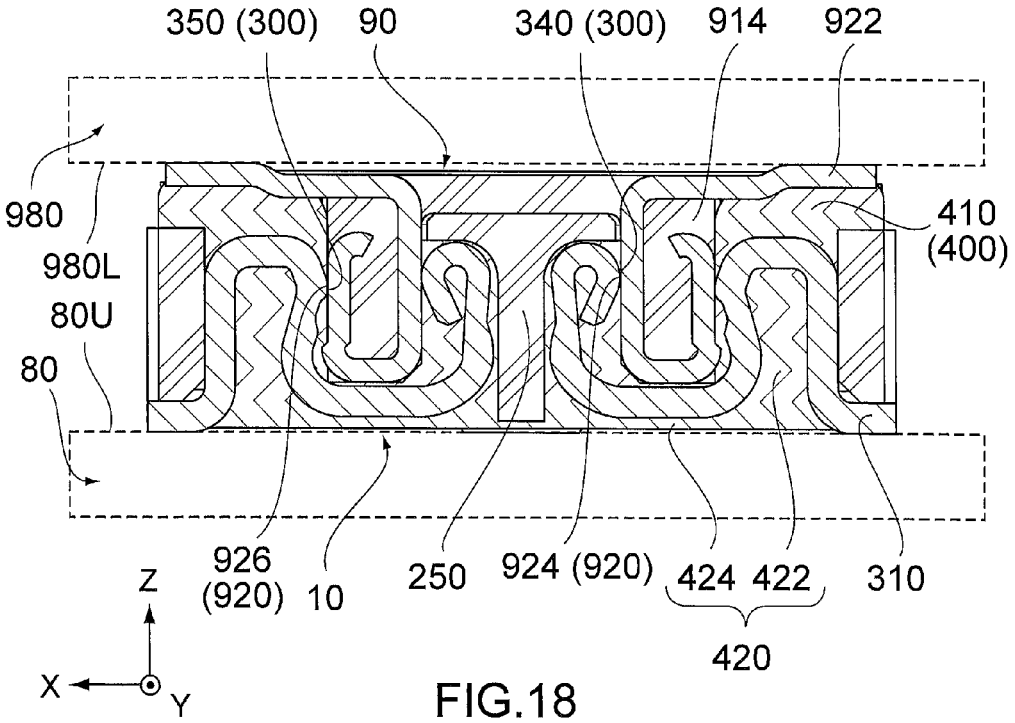
FIG. 18 is a cross-sectional view showing the connector and the mating connector of FIG. 17, taken along line XVIII-XVIII, wherein each position of a circuit board and a mating circuit board is illustrated by dashed line.
Figure 19:
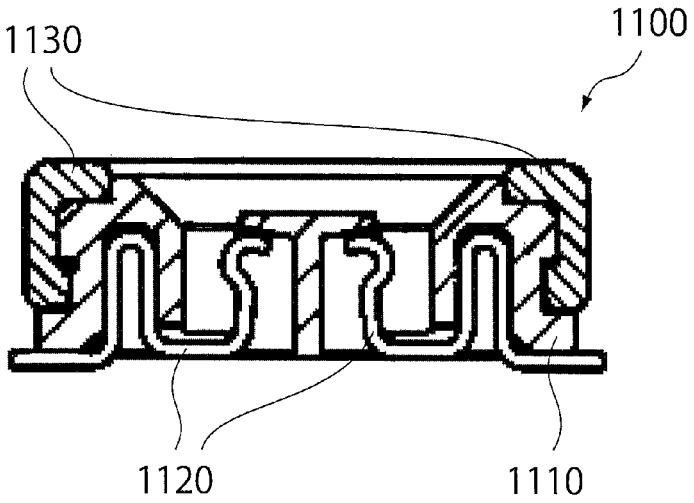
FIG.19 PRIOR ART
FIG. 19 is a cross-sectional view showing a connector of Patent Document 1.
Figure 20:
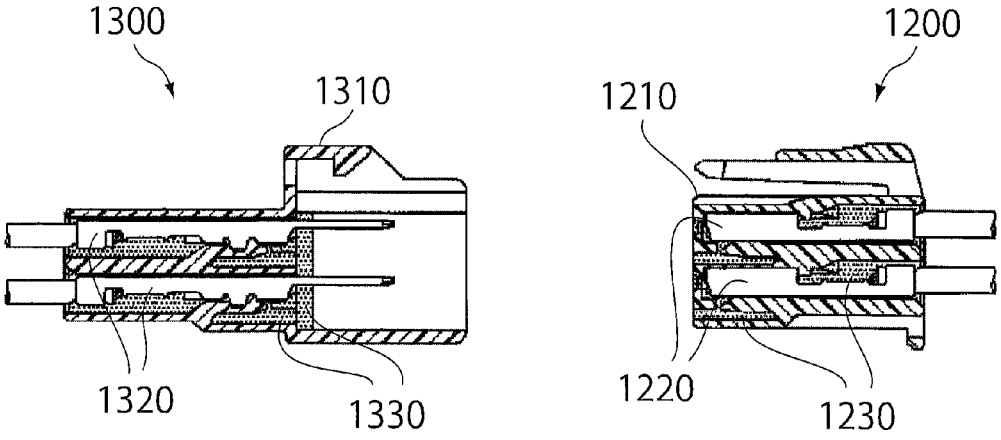
FIG.20 PRIOR ART
FIG. 20 is a cross-sectional view showing a connector and a mating connector of Patent Document 2.

As can be seen from FIGS. 16 and 18, the mating contacts 920 are embedded into the mating housing 910 via insert molding and held by the mating housing 910. Each of the mating contacts 920 has an SMT portion 922, a first contact-point (contact-point) 924 and a second contact-point (contact-point) 926. The SMT portion 922 extends outward in the X-direction from the mating housing 910. The first contact-point 924 is exposed within the recess 912, and the second contact-point 926 is exposed on an outer surface of the protruding portion 914. When the mating connector 90 is mounted on the mating circuit board 980, the SMT portions 922 are connected to the respective conductive patterns (not shown) formed on the lower surface 980L of the mating circuit board 980, for example, by soldering, so that the mating connector 90 is fixed to the mating circuit board 980. The first contact-points 924 and the second contact-points 926 are electrically connected with the connector 10 under a mated state where the connector 10 and the mating connector 90 are mated with each other.

As shown in FIGS. 1 to 5, the connector 10 comprises a housing 200 made of insulator, a plurality of contacts 300 each made of conductor, a sealing member 400 made of elastic material and two reinforcement members 500 each made of metal. The connector 10 has an upper end 10U and a lower end 10L which are located at opposite ends thereof in the Z-direction, respectively.

Figure 6:
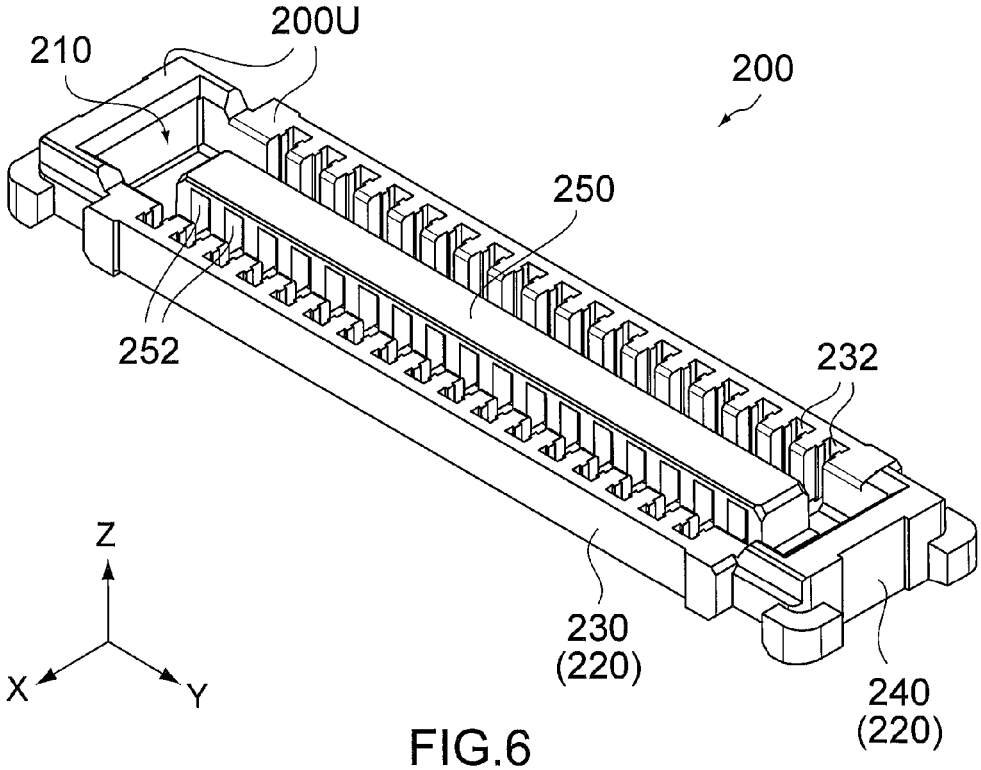
FIG. 6 is a perspective view showing a housing of the connector of FIG. 1.
Figure 8:
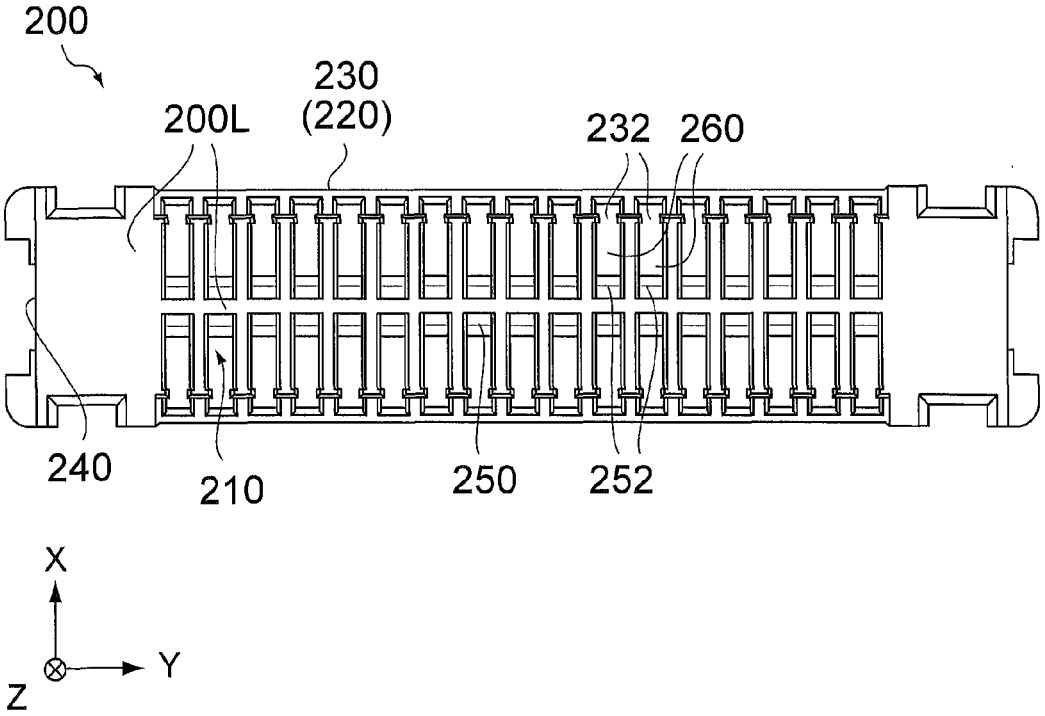
FIG. 8 is a bottom view showing the housing of FIG. 6.
Figure 9:
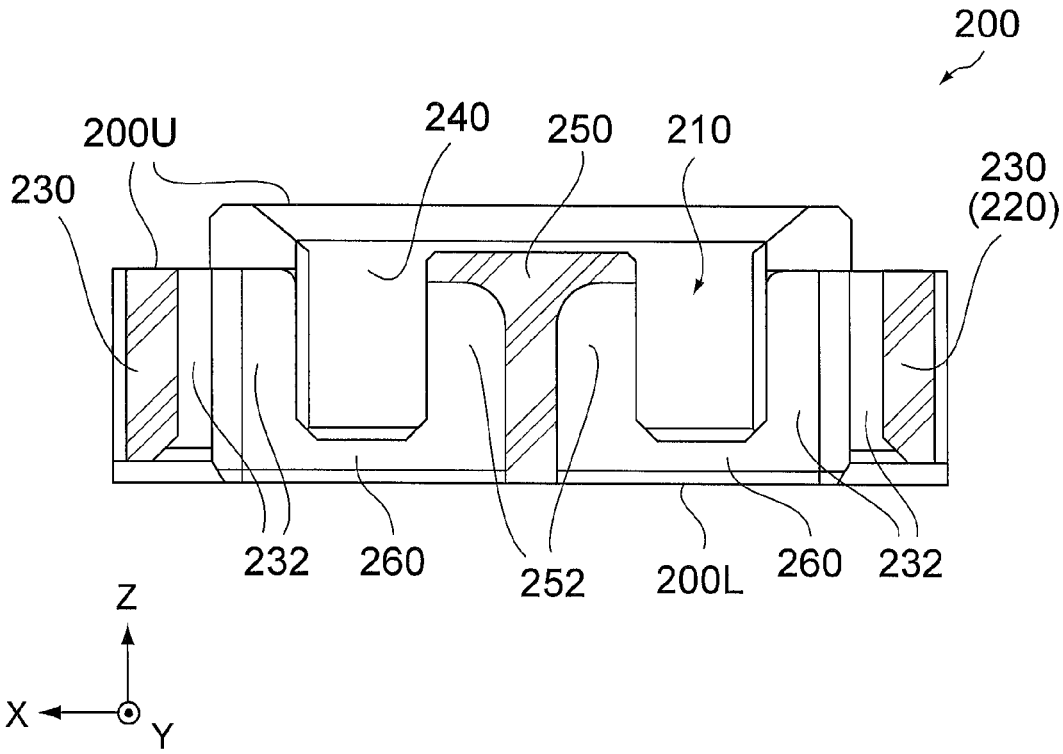
FIG. 9 is a cross-sectional view showing the housing of FIG. 7, taken along line IX-IX.

As shown in FIGS. 6, 8 and 9, the housing 200 has an upper face (mating face) 200U and a lower face (bottom face) 200L which are located at opposite ends thereof in the Z-direction, respectively. The upper face 200U is an end face of an upper side (positive Z-side) of the housing 200. The upper face 200U has a middle portion in a longitudinal direction (Y-direction) and opposite end portions in the Y-direction, wherein the middle portion is located at a position lower than those of the end portions. The bottom face 200L is an end face of a lower side (negative Z-side) of the housing 200. The bottom face 200L is located below the upper face 200U.

The housing 200 has an accommodation portion 210. The accommodation portion 210 is recessed downward (in the negative Z-direction) from the upper face 200U. The accommodation portion 210 according to the present embodiment has a frame-like shape in the XY-plane perpendicular to the mating direction (Z-direction). The accommodation portion 210 reaches the bottom face 200L in the Z-direction. The accommodation portion 210 has a plurality of fixing portions 232, a plurality of receiving portions 252 and a plurality of channels 260. Each of the fixing portion 232, the receiving portion 252 and the channel 260 partially accommodates the contact 300 (see FIGS. 9 and 15).

As shown in FIGS. 6 to 9, the housing 200 further has an outer wall 220 and a projecting portion 250. The outer wall 220 forms a circumference of the housing 200. The outer wall 220 encloses the accommodation portion 210 in the XY-plane. The upper face 200U is formed at an upper end (positive Z-side end) of the outer wall 220. The projecting portion 250 is formed inside of the accommodation portion 210 in the XY-plane. In other words, the accommodation portion 210 encloses the projecting portion 250 in the XY-plane.

The outer wall 220 is formed of two long walls 230 and two short walls 240, wherein the long walls 230 extend long in the Y-direction, and the short walls 240 extend short in a width direction (X-direction). Each of the long walls 230 connects corresponding ends of the short walls 240 in the X-direction so that the outer wall 220 has a frame-like shape in the XY-plane. According to the present embodiment, the fixing portions 232 are formed on facing sides of the long walls 230 which face the projecting portion 250. Each of the fixing portions 232 is a recess which is recessed outward in the X-direction. The fixing portions 232 pierce the housing 200 in the Z-direction.

The projecting portion 250 projects upward (in the positive Z-direction) while extending long in the Y-direction. The projecting portion 250 is coupled to the outer wall 220 at the bottom face 200L. According to the present embodiment, the receiving portions 252 are formed on facing sides of the projecting portion 250, which face the long walls 230, so as to correspond to the fixing portions 232, respectively. Each of the receiving portions 252 is a recess formed at a lower part (negative Z-side part) of the projecting portion 250. In detail, the receiving portions 252 are recessed toward the inside of the projecting portion 250 in the X-direction. The receiving portions 252 pierce the bottom face 200L of the housing 200 in the Z-direction.

Figure 7:
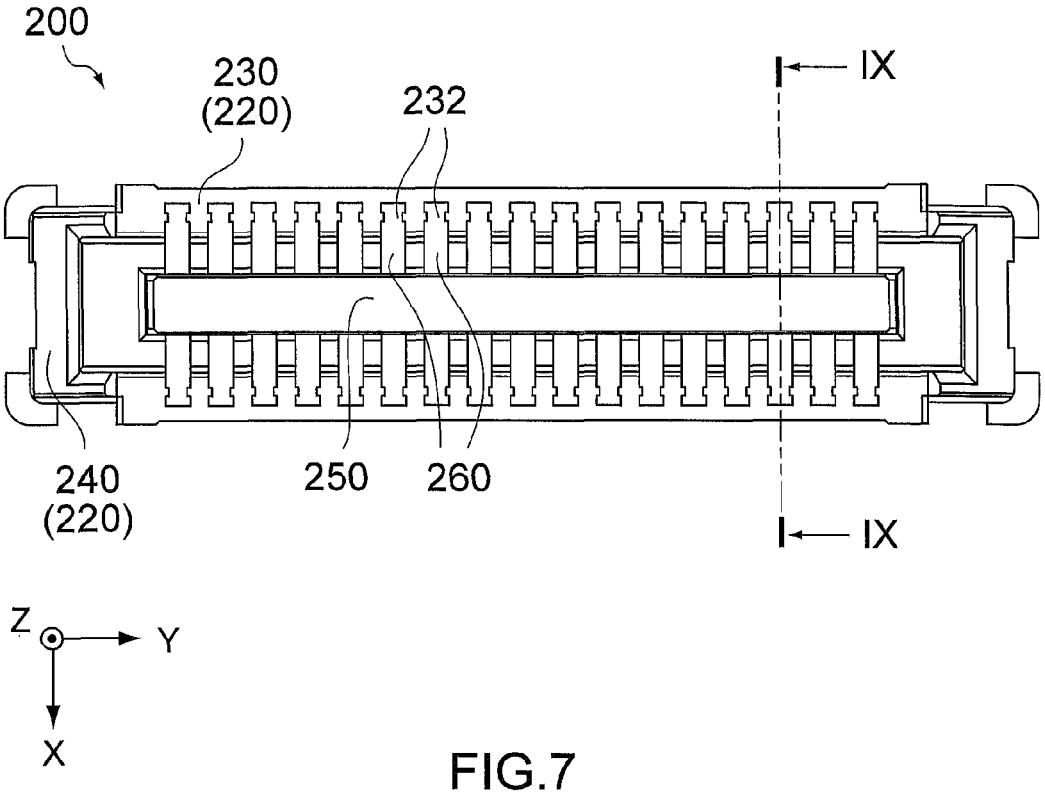
FIG. 7 is a top view showing the housing of FIG. 6.

As shown in FIGS. 7 to 9, according to the present embodiment, the channels 260 are formed in the bottom face 200L of the housing 200. The channels 260 are located at a lower end (negative Z-side end) of the accommodation portion 210. Each fixing portion 232 has a lower end which communicates with a lower end of the receiving portion 252 in the X-direction via the channel 260. The channels 260 pierce the bottom face 200L in the Z-direction. Accordingly, the accommodation portion 210 partially opens downward from the bottom face 200L along the Z-direction when the contacts 300 and the sealing member 400 are not attached to the housing 200 yet.

Figure 10:
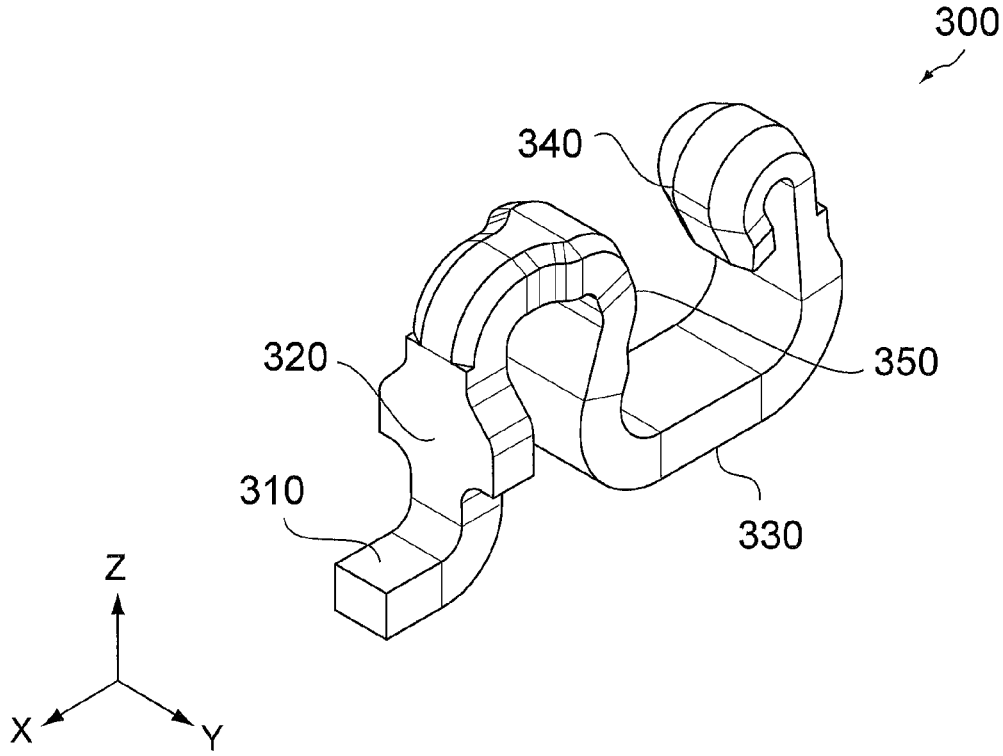
FIG. 10 is a perspective view showing a contact of the connector of FIG. 1.
Figure 15:
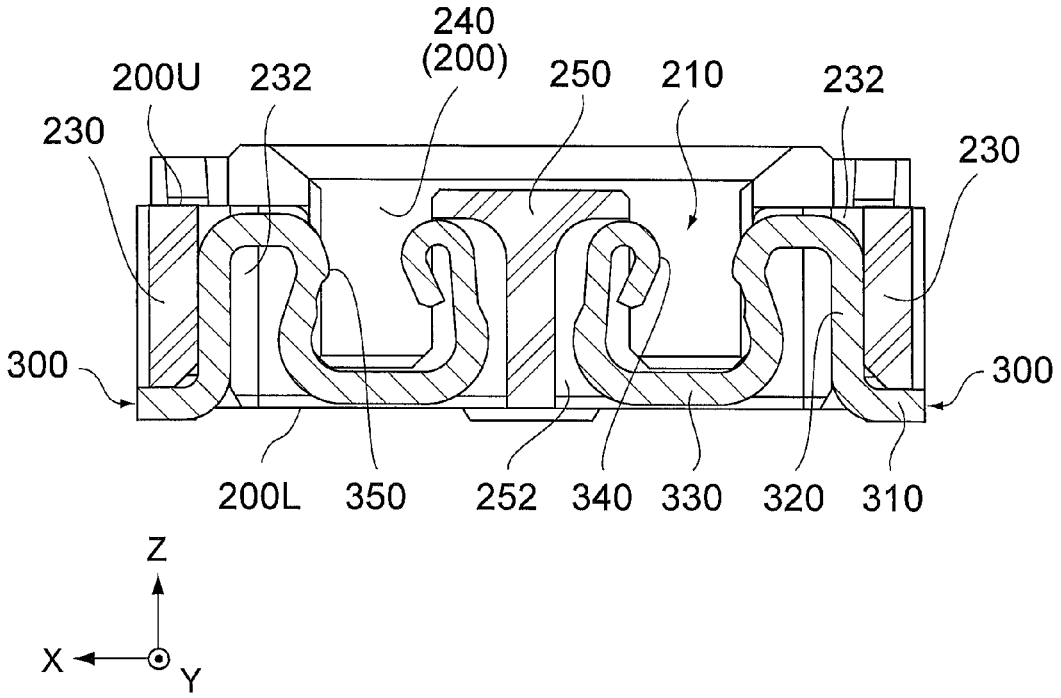
FIG. 15 is a cross-sectional view showing the housing of FIG. 13, taken along line XV-XV.

As shown in FIGS. 10 and 15, each of the contacts 300 according to the present embodiment is formed by bending a single metal plate. Each of the contacts 300 has an SMT portion 310, a fixed portion 320, a spring portion 330, a first contact-point (contact-point) 340 and a second contact-point (contact-point) 350. The first contact-point 340 and the second contact-point 350 are designed to be brought into contact with the first contact-point 924 and the second contact-point 926 of the mating contact 920, respectively (see FIG. 18). The contacts 300 are press-fit into the accommodation portion 210 from the bottom face 200L of the housing 200 (see FIG. 15). In detail, the fixed portion 320 is press-fit into a press-fit groove of the fixing portion 232. As a result, the contacts 300 are held by the housing 200 and partially accommodated in the accommodation portion 210.

As shown in FIGS. 15 and 18, the SMT portion 310 passes under the long wall 230 in the X-direction to extend outward in the X-direction from the housing 200. When the connector 10 is mounted on the circuit board 80, the SMT portions 310 are connected to the respective conductive patterns (not shown) formed on the upper surface 80U of the circuit board 80, for example, by soldering, so that the connector 10 is fixed to the circuit board 80 (see FIG. 18).

The fixed portion 320 extends upward from the SMT portion 310 within the fixing portion 232 of the accommodation portion 210. The spring portion 330 extends roughly downward from an upper end (positive Z-side end) of the fixed portion 320. The spring portion 330 partially projects into the inside of the accommodation portion 210 so that the second contact-point 350 is formed. The spring portion 330 extends to the receiving portion 252 through the channel 260 of the accommodation portion 210 after extending downward. Subsequently, the spring portion 330 extends upward within the receiving portion 252. A part of the contact 300 further extends upward from the spring portion 330 and is subsequently bent downward to partially project into the inside of the accommodation portion 210 so that the first contact-point 340 is formed. Each of the first contact-point 340 and the second contact-point 350 is exposed in the accommodation portion 210. The first contact-point 340 is resiliently supported by the spring portion 330 to be movable mainly inward in the X-direction while the second contact-point 350 is resiliently supported by the spring portion 330 to be movable mainly outward in the X-direction. Under the mated state of the connector 10 with the mating connector 90, the first contact-point 340 and the second contact-point 350 are in contact with the first contact-point 924 and the second contact-point 926 of the mating contact 920 of the mating connector 90, respectively, so that the connector 10 and the mating connector 90 are electrically connected with each other (see FIG. 18).

Figure 13:
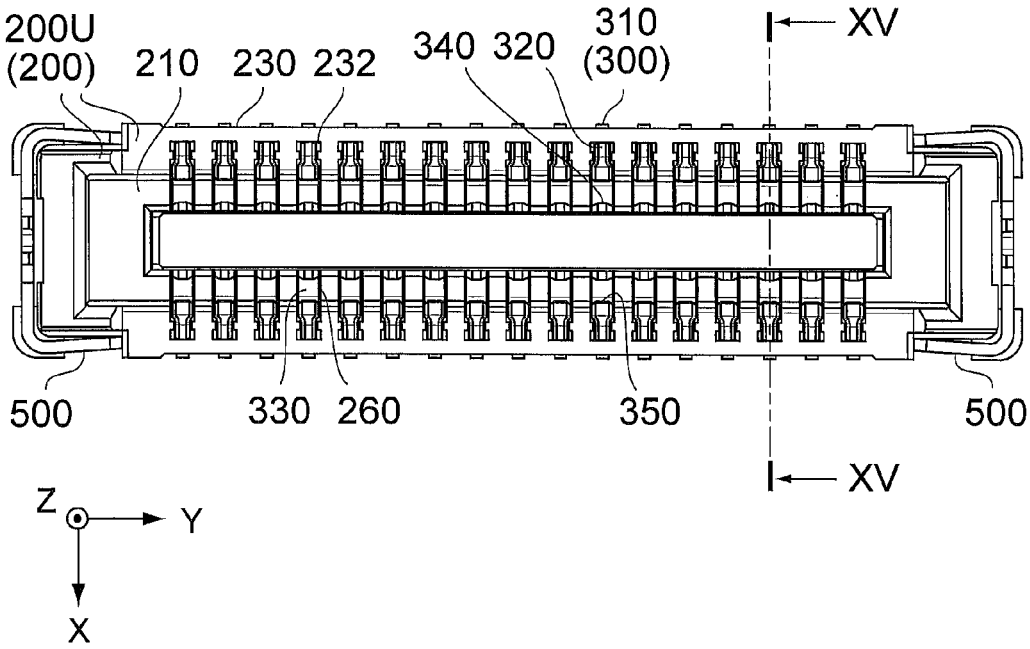
FIG. 13 is a top view showing the housing of FIG. 12.
Figure 14:
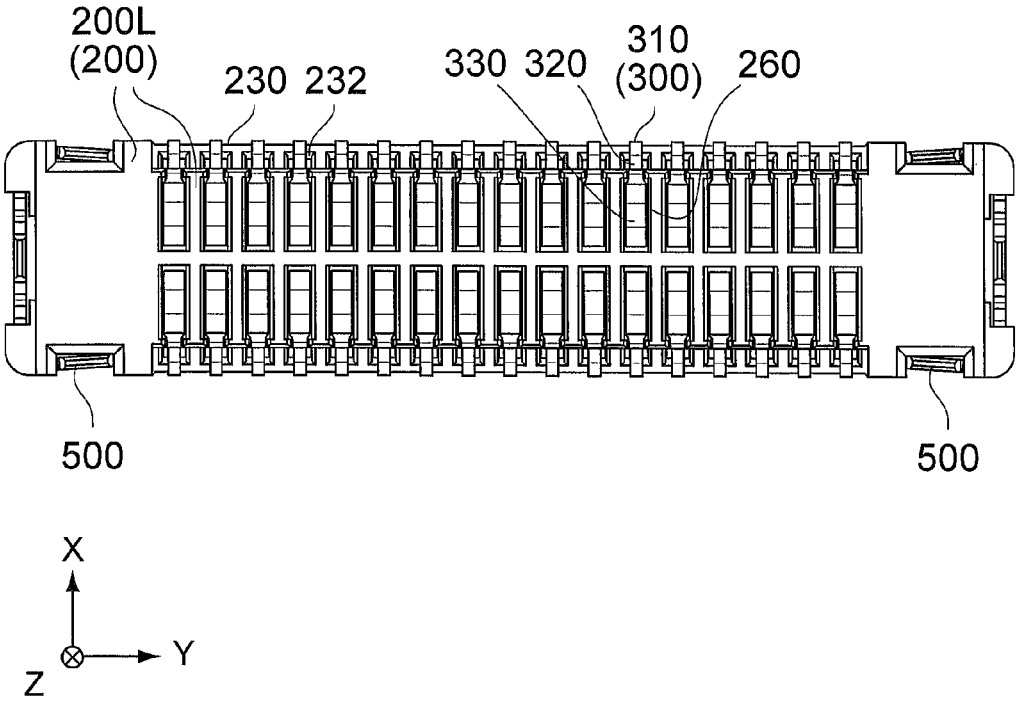
FIG. 14 is a bottom view showing the housing of FIG. 12.

As shown in FIGS. 13 and 14, when the contacts 300 are attached to the housing 200, the channels 260 are almost covered by the spring portions 330. However, when the housing 200 is seen from the bottom face 200L, an upper portion of the accommodation portion 210 is visible through parts of the channels 260. In other words, according to the present embodiment, even after the contacts 300 are attached to the housing 200, the accommodation portion 210 partially opens downward from the bottom face 200L along the Z-direction.

Figure 11:
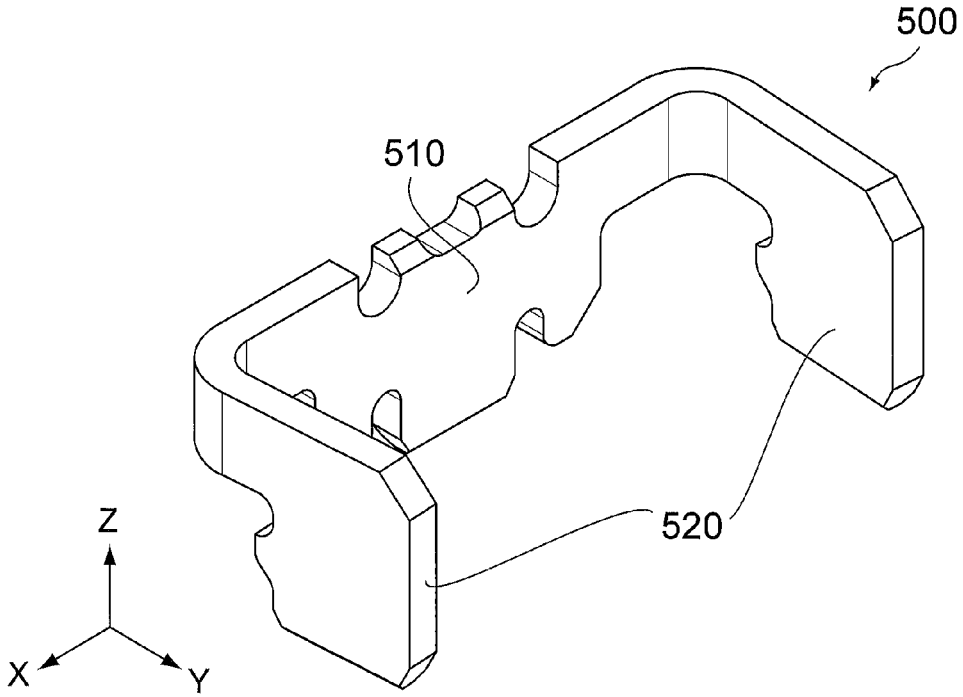
FIG. 11 is a perspective view showing a reinforcement member of the connector of FIG. 1.
Figure 12:
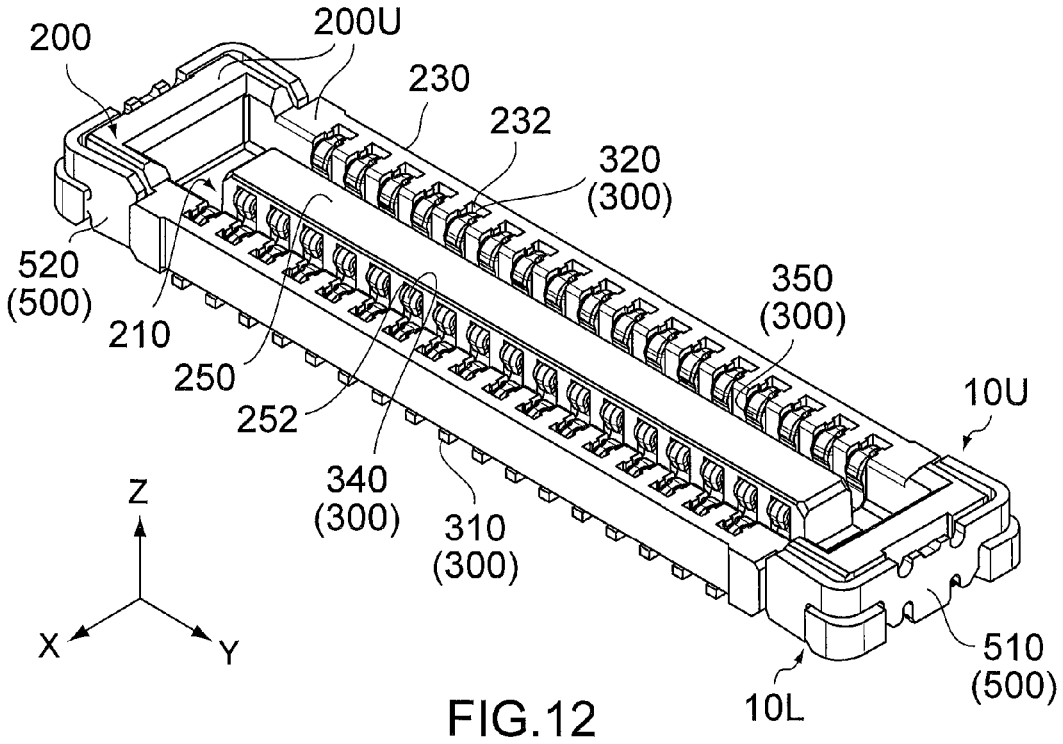
FIG. 12 is a perspective view showing the housing of FIG. 6 in a state where the contacts and the reinforcement member are attached thereto.

As shown in FIGS. 11 and 12, each of the reinforcement members 500 according to the present embodiment is formed by bending a single metal plate. Each of the reinforcement members 500 has a body portion 510 and two held portions 520. The held portions 520 are formed at opposite ends of the body portion 510 in the X-direction, respectively. The body portion 510 has a flat plate-like shape, and each of the held portions 520 has a flat plate-like shape perpendicular to the body portion 510. The reinforcement members 500 are attached to the housing 200 so as to cover outer surfaces of the short walls 240, respectively. In detail, each short wall 240 has recesses formed on the respective outer surfaces thereof in the X-direction, and the held portions 520 of each reinforcement member 500 are press-fit into the recesses, respectively, so that the reinforcement member 500 is held by the housing 200. The body portions 510 of the reinforcement members 500 held by the housing 200 cover the outer surfaces of the short walls 240 in the Y-direction. When the connector 10 is mounted on the circuit board 80 (see FIG. 18), lower ends of the reinforcement members 500 are fixed to the upper surface 80U of the circuit board 80, for example, by soldering, so that the connector 10 is reinforced.

Figure 5:
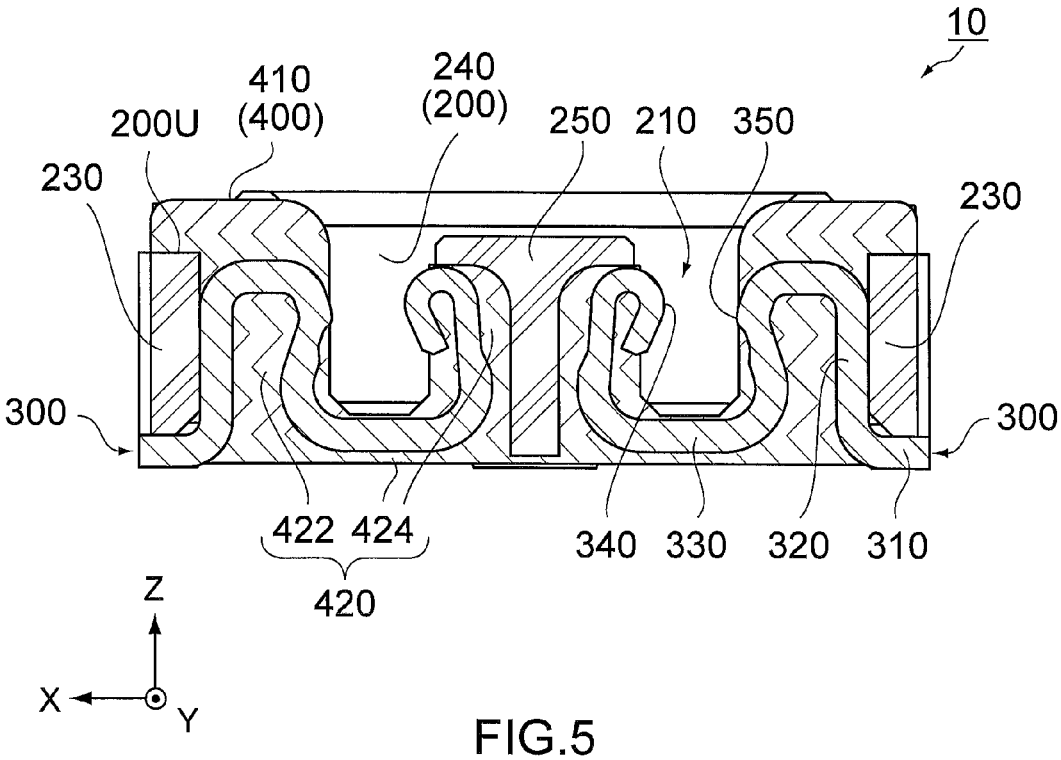
FIG. 5 is a cross-sectional view showing the connector of FIG. 2, taken along line V-V.

As can be seen from FIGS. 1 and 5, the sealing member 400 according to the present embodiment is made of insulative resin such as silicone resin or urethane resin. The aforementioned insulative resin, which is in a sol state or in a liquid state at first, is poured into the accommodation portion 210 from the upper face 200U of the housing 200. The poured Insulative resin is solidified so that the sealing member 400 is formed. In detail, the sealing member 400 can be formed as described below, for example. First, a dummy member is prepared, wherein the dummy member has a size and a shape similar to those of the mating connector 90 (see FIG. 16). Then, the contacts 300 and the reinforcement members 500 are attached to the housing 200 (see FIG. 12). Then, the housing 200 and the dummy member are temporarily mated with each other (see FIG. 17). Then, the insulative resin is poured into gaps formed between the housing 200 and the dummy member, and thus, a predetermined portion of the housing 200 is covered with the insulative resin. After the insulative resin is solidified, the dummy member is removed from the housing 200.

As shown in FIGS. 1 to 5, the sealing member 400 formed as described above has a contact portion 410 and an accommodated portion 420. The contact portion 410 is located on the upper face 200U of the housing 200. The accommodated portion 420 extends into the accommodation portion 210 from the contact portion 410 and is held in the accommodation portion 210.

Referring to FIGS. 5 and 15, the accommodated portion 420 extends downward from the contact portion 410 while filling the fixing portions 232 of the housing 200 so that side portions 422 are formed. The side portions 422 extend within the housing 200 along the long walls 230, respectively. Furthermore, the accommodated portion 420 extends over the XY-plane while covering the bottom face 200L of the housing 200 from below (see FIG. 3) so that a bottom portion 424 is formed. The bottom portion 424 is located between the side portions 422 in the X-direction. The bottom portion 424 has a middle portion in the X-direction, wherein the middle portion extends upward within the receiving portions 252 to fill the receiving portions 252.

The accommodated portion 420 according to the present embodiment partially covers each of the contacts 300. In detail, the accommodated portion 420 covers parts of each contact 300, which are located within the accommodation portion 210, except the first contact-point 340 and the second contact-point 350. In other words, the most parts of the contact 300, including portions in the vicinities of the first contact-point 340 and the second contact-point 350, are covered by the sealing member 400. However, the first contact-point 340 projects outward in the X-direction from a part of the bottom portion 424, or from the sealing member 400 located in the receiving portion 252, to be exposed in the accommodation portion 210. Similarly, the second contact-point 350 slightly projects inward in the X-direction from the side portion 422, or from the sealing member 400 located in the fixing portion 232, to be exposed in the accommodation portion 210. In addition, the sealing member 400 according to the present embodiment is formed of soft material that is elastically easily deformed. Accordingly, the first contact-point 340 can be resiliently easily deformed inward in the X-direction. Similarly, the second contact-point 350 can be resiliently easily deformed outward in the X-direction.

Figure 3:
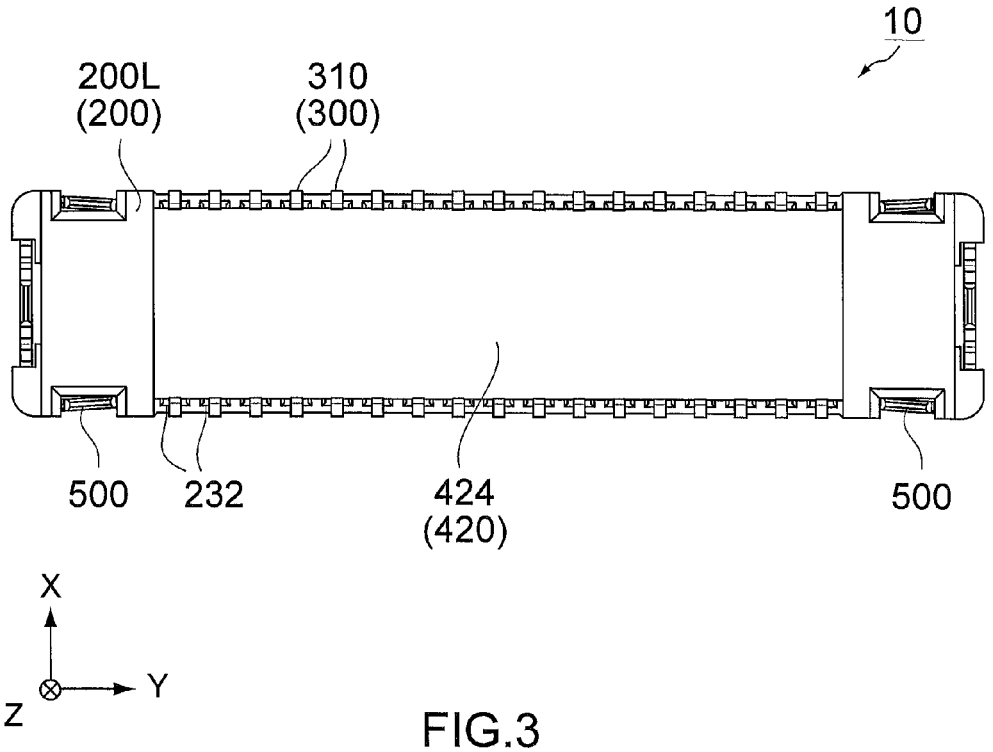
FIG. 3 is a bottom view showing the connector of FIG. 1.
Figure 4:
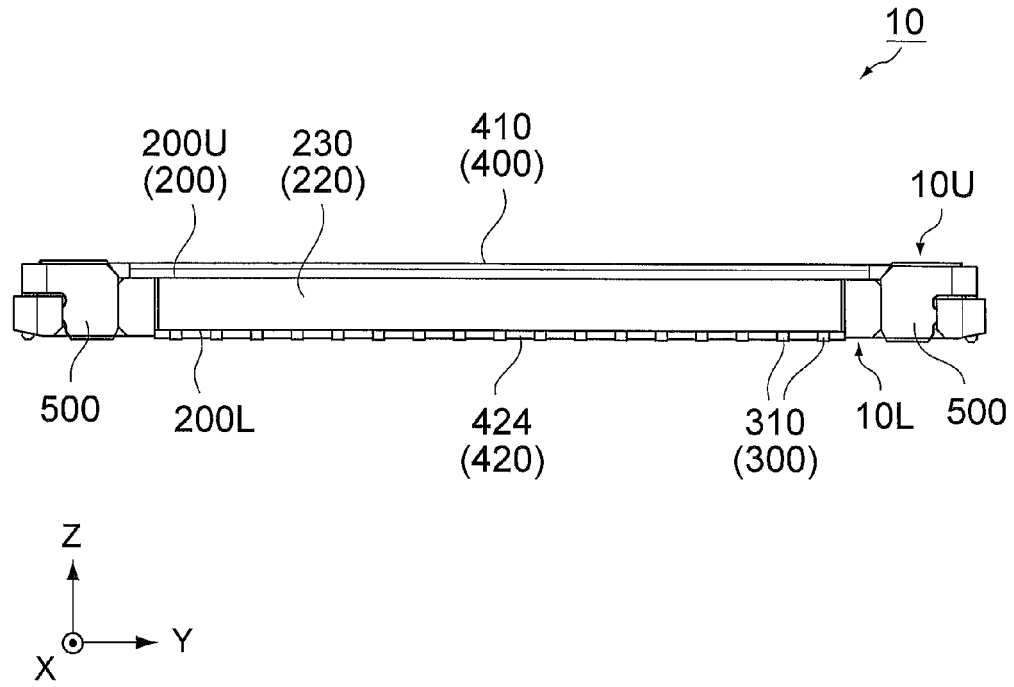
FIG. 4 is a side view showing the connector of FIG. 1.

Referring to FIGS. 3 and 14, the bottom portion 424 of the accommodated portion 420 covers a middle portion of the bottom face 200L in the Y-direction so as to wholly hide the contacts 300 except the SMT portions 310. In other words, when the connector 10 is seen from the bottom face 200L, the accommodated portion 420 hides parts of the contacts 300 located in the accommodation portion 210. Moreover, according to the present embodiment, when the connector 10 is seen from the bottom face 200L, the accommodated portion 420 hides the accommodation portion 210.

Figure 2:
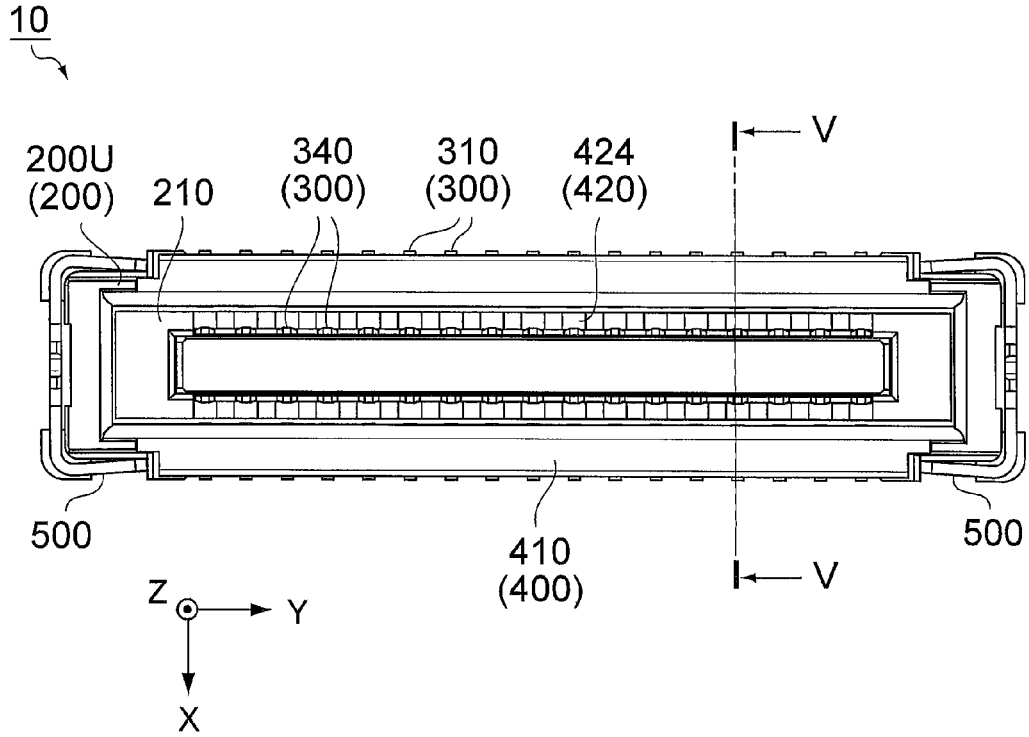
FIG. 2 is a top view showing the connector of FIG. 1.

As can be seen from FIGS. 2 and 13, a size of the connector 10 after the formation of the sealing member 400 is, in the XY-plane, same as a size of the connector 10 before the formation of the sealing member 400. Moreover, as can be seen from FIGS. 4, 5 and 15, a height, or a size in the Z-direction, of the connector 10 after the formation of the sealing member 400 is same as a height of the connector 10 before the formation of the sealing member 400. According to the present embodiment, the sealing member 400 can be formed without upsizing of the connector 10 in the XY-plane and in the Z-direction. Accordingly, the connector 10 can be waterproofed and protected without enlarging a mounting area, or an area of a section of the circuit board 80 (see FIG. 18) on which the connector 10 is mounted.

As can be seen from FIGS. 3 and 18, when the connector 10 formed as described above is mounted on the upper surface 80U of the circuit board 80, the accommodated portion 420 of the sealing member 400 seals gaps between the connector 10 and the circuit board 80 so that the connector 10 is waterproofed and protected. Moreover, when the connector 10 is mounted on the circuit board 80, a lower end (negative Z-side end) of the accommodated portion 420 is located above the upper surface 80U with a slight distance from the upper surface 80U. Accordingly, the SMT portions 310 of the contacts 300 are in contact with the upper surface 80U without pressing the connector 10 downward. The SMT portions 310 can be therefore relatively easily fixed to, for example, soldered to, the upper surface 80U.

However, the accommodated portion 420 can be formed so that the lower end thereof is brought into contact with the upper surface 80U upon the mounting of the connector 10 on the circuit board 80. In other words, the SMT portions 310 can be formed so as to be located above the upper surface 80U with a distance upon the mounting of the connector 10 on the circuit board 80. In this case, the bottom portion 424 (see FIG. 3) of the accommodated portion 420 does not need to be formed with a part thereof located at the middle thereof in the XY-plane, or the part thereof located under the accommodation portion 210. In other words, the accommodated portion 420 may be provided so that the accommodation portion 210 partially opens downward from the bottom face 200L along the Z-direction.

As can be seen from FIGS. 1 and 16 to 18, when the connector 10 and the mating connector 90, which are formed as described above, are mated with each other, the projecting portion 250 of the connector 10 is accommodated into the recess 912 of the mating connector 90, and the protruding portion 914 of the mating connector 90 is accommodated into the accommodation portion 210 of the connector 10. In the meantime, the SMT portions 922 of the mating contacts 920 are pressed against the contact portion 410 of the sealing member 400 and are buried into the contact portion 410 so as to be wrapped by the contact portion 410 (see FIGS. 17 and 18). Moreover, under the mated state, the first contact-points 340 of the contacts 300 are brought into contact with the first contact-points 924 of the mating contacts 920, respectively, to be pressed inward in the X-direction. The first contact-points 340, which are pressed by the first contact-points 924, are moved inward in the X-direction while being buried into the accommodated portion 420. Similarly, the second contact-points 350 of the contacts 300 are brought into contact with the second contact-points 926 of the mating contacts 920 to be slightly moved outward in the X-direction.

As can be seen from FIG. 18, under the mated state, or when the connector 10 and the mating connector 90 are completely mated with each other, the accommodated portion 420 of the sealing member 400 waterproofs and protects a contact section between the first contact-point 340 of the contact 300 and the first contact-point 924 of the mating contact 920. Similarly, the accommodated portion 420 of the sealing member 400 also waterproofs and protects a contact section between the second contact-point 350 of the contact 300 and the second contact-point 926 of the mating contact 920. In other words, the connector 10 is waterproofed and protected. In addition, if the contact portion 410 of the sealing member 400 is formed to be located slightly higher than the upper end 10U of the connector 10 in the Z-direction, the contact portion 410 of the sealing member 400 is in close contact with the lower surface 980L of the mating circuit board 980 under the mated state. The thus-formed contact portion 410 seals gaps between the connector 10 and the mating circuit board 980 under the mated state. In other words, the connector 10 can be more securely waterproofed and protected.

As can be seen from the above description, the contact portion 410 of the sealing member 400 according to the present embodiment is formed so as to be in close contact with a part of the mating connector 90 or the mating circuit board 980 (i.e. support member) which mounts (i.e. supports) the mating connector 90. Accordingly, the sealing member 400 can waterproof and protect the contact section between the first contact-point 340 and the first contact-point 924 as well as the contact section between the second contact-point 350 and the second contact-point 926. According to the present embodiment, even if the mating connector 90 is provided with no sealing member, the connector 10 can be waterproofed and protected. However, the mating connector 90 may comprises a sealing member. Moreover, the second contact-point 350 of the contact 300 and the second contact-point 926 of the mating contact 920 are not always necessary. In other words, the contact 300 may be provided with only the first contact-point 340, and the mating contacts 920 may be provided with only the first contact-point 924.

According to the present embodiment, after the connector 10 is mounted on the circuit board 80, no potting and no coating for waterproof is required to seal between the connector 10 and the circuit board 80. Accordingly, each of the connector 10 and the circuit board 80 can be easily replaced or repaired as necessary.

The connector according to the present invention is not limited to the aforementioned embodiment. The connector according to the present invention can be variously modified.

For example, the accommodated portion 420 of the sealing member 400 does not need to cover the vicinity of the first contact-point 340 of the contact 300. In other words, the accommodated portion 420 does not need to fill the inside of the receiving portion 252, provided that the bottom portion 424 is provided.

Moreover, the housing 200 can be formed so that the contacts 300 are press-fit into the accommodation portion 210 from the upper face 200U of the housing 200. In this case, a lower end of the housing 200 does not need to be provided with a hole except the holes where the SMT portions 310 pass through. Accordingly, the lower end of the housing 200 can be sealed only by the side portions 422. In other words, a lower part of the connector 10 can be waterproofed and protected only by the side portions 422.

Moreover, under the mated state of the connector 10 and the mating connector 90, the contact portion 410 of the sealing member 400 may be in close contact with a portion other than the lower surface 980L of the mating circuit board 980 or a member other than the mating circuit board 980. For example, in a case where the mating connector 90 is provided with a sealing member, the contact portion 410 may be in close contact with the sealing member of the mating connector 90.

Moreover, the shape of each of the connector 10 and the mating connector 90 is not limited to that of the aforementioned embodiment. Moreover, each of the connector 10 and the mating connector 90 does not need to be an on-board connector that is to be mounted on a circuit board.

The present application is based on a Japanese patent application of JP2012-264173 filed before the Japan Patent Office on Dec. 3, 2012, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 connector
10U upper end
10L lower end
200 housing
200U upper face (mating face)
200L lower face (bottom face)
210 accommodation portion
220 outer wall
230 long wall
232 fixing portion
240 short wall
250 projecting portion
252 receiving portion
260 channel
300 contact
310 SMT portion
320 fixed portion
330 spring portion
340 first contact-point (contact-point)
350 second contact-point (contact-point)
400 sealing member
410 contact portion
420 accommodated portion
422 side portion
424 bottom portion
500 reinforcement member
510 body portion
520 held portion
80 circuit board
80U upper surface
90 mating connector
910 mating housing
912 recess
914 protruding portion
920 mating contact
922 SMT portion
924 first contact-point (contact-point)
926 second contact-point (contact-point)
980 mating circuit board
980L lower surface
1100 socket connector (connector)
1110 socket connector housing (housing)
1120 contact
1130 sealing member
1200 female connector (connector)
1210 housing
1220 female terminal (contact)
1230 insulative resin (sealing member)
1300 male connector (mating connector)
1310 housing (mating housing)
1320 male terminal (mating contact)
1330 insulative resin (sealing member)

The invention claimed is:

1. A connector mateable with a mating connector along an upper-lower direction, the connector comprising a housing, a plurality of contacts and a sealing member, wherein:

the housing has an upper face in the upper-lower direction and an accommodation portion recessed downward from the upper face;

the contacts are held by the housing and partially accommodated in the accommodation portion;

the sealing member has a contact portion and an accommodated portion, the contact portion being located on the upper face of the housing, the accommodated portion being held in the accommodation portion and extending into the accommodation portion from the contact portion;

the connector is mountable on an upper surface of a circuit board in the upper-lower direction; and when the connector is mounted on the upper surface of the circuit board, the accommodated portion of the sealing member seals a gap between the connector and the circuit board.

2. The connector as recited in claim 1, wherein:

the mating connector includes a mating contact;

the accommodated portion partially covers each of the contacts;

the contact has a contact-point;

the contact-point is exposed in the accommodation portion; and under a mated state where the connector and the mating connector are mated with each other, the contact-point is in contact with the mating contact.

3. The connector as recited in claim 1, wherein the contact is press-fit into the accommodation portion from the upper face of the housing.

4. The connector as recited in claim 1, wherein:

the mating connector is mounted on a lower surface of a mating circuit board in the upper-lower direction; and when the connector and the mating connector are mated with each other, the contact portion of the sealing member seals a gap between the connector and the mating circuit board.

5. The connector as recited in claim 1, wherein:

the housing has a bottom face;

the bottom face is located below the upper face;

the accommodation portion reaches the bottom face; and the contact is press-fit into the accommodation portion from the bottom face of the housing.

6. The connector as recited in claim 5, wherein, when the connector is seen from the bottom face, the accommodated portion hides a part of the contact, the part being located in the accommodation portion.

7. The connector as recited in claim 5, wherein, when the connector is seen from the bottom face, the accommodated portion hides the accommodation portion.

8. The connector as recited in claim 5, wherein the accommodation portion partially opens downward from the bottom face along the upper-lower direction.

9. A connector mateable with a mating connector along an upper-lower direction, the connector comprising a housing, a plurality of contacts and a sealing member, wherein:

the housing has an upper face in the upper-lower direction and an accommodation portion recessed downward from the upper face;

the contacts are held by the housing and partially accommodated in the accommodation portion;

the sealing member has a contact portion and an accommodated portion, the contact portion being located on the upper face of the housing, the accommodated portion being held in the accommodation portion and extending into the accommodation portion from the contact portion;

the mating connector is mounted on a lower surface of a mating circuit board in the upper-lower direction; and when the connector and the mating connector are mated with each other, the contact portion of the sealing member seals a gap between the connector and the mating circuit board.

* * * * *